United States Patent [19]

Schreyer et al.

[11] 4,361,312

[45] Nov. 30, 1982

[54] PRECISE LOAD POSITIONER

[75] Inventors: Kenneth D. Schreyer, Clarence; Alton H. Cooper, Kenmore, both of N.Y.

[73] Assignee: Columbus McKinnon Corporation, Tonawanda, N.Y.

[21] Appl. No.: 263,161

[22] Filed: May 13, 1981

Related U.S. Application Data

[63] Continuation of Ser. No. 10,070, Feb. 7, 1979, abandoned.

[51] Int. Cl.[3] ..... B66D 1/48; B66D 5/30

[52] U.S. Cl. ..... 254/276; 254/362; 254/375

[58] Field of Search ..... 254/266, 267, 268, 275, 254/276, 291, 292, 356, 361, 362, 360, 375-379; 414/275; 318/363, 372, 614; 188/134, 171; 212/132

[56] References Cited

U.S. PATENT DOCUMENTS

| | | | |
|---|---|---|---|
| 2,403,125 | 7/1946 | Santini et al. | 318/363 X |
| 2,656,027 | 10/1953 | Crookston | 254/276 X |
| 2,752,120 | 6/1956 | Bogle | 254/337 |
| 2,912,224 | 11/1959 | Logan | 254/276 |
| 3,053,344 | 9/1962 | Buck | 254/276 X |
| 3,883,859 | 5/1975 | Ancheta | 212/157 |
| 4,087,078 | 5/1978 | Joraku et al. | 254/362 |

FOREIGN PATENT DOCUMENTS

| | | |
|---|---|---|
| 283230 | 10/1965 | Australia . |
| 826133 | 12/1959 | United Kingdom . |

*Primary Examiner*—John M. Jillions

*Attorney, Agent, or Firm*—Bean, Kauffman & Bean

[57] ABSTRACT

A device for precisely positioning a hoist suspended load which operates by temporarily releasing the hoist brake for a predetermined limited time period without actuating the hoist motor so that the load is lowered through a small incremental distance by the influence of its own weight. A control signal may be generated by a delay timer, a repeat cycle timer, a digital timing device or a device for detecting the degree of movement of the load carried by the hoist.

11 Claims, 4 Drawing Figures

Fig. 1.
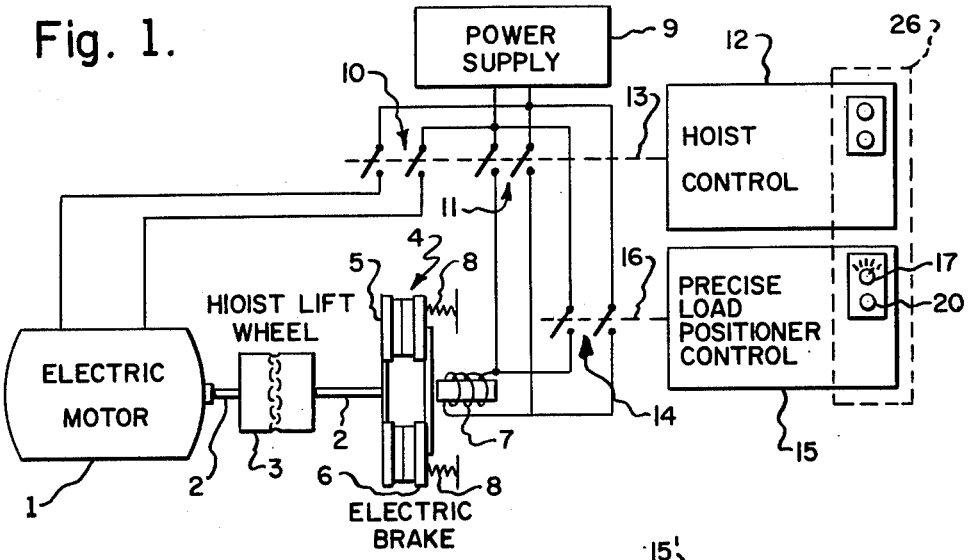
Fig. 2.
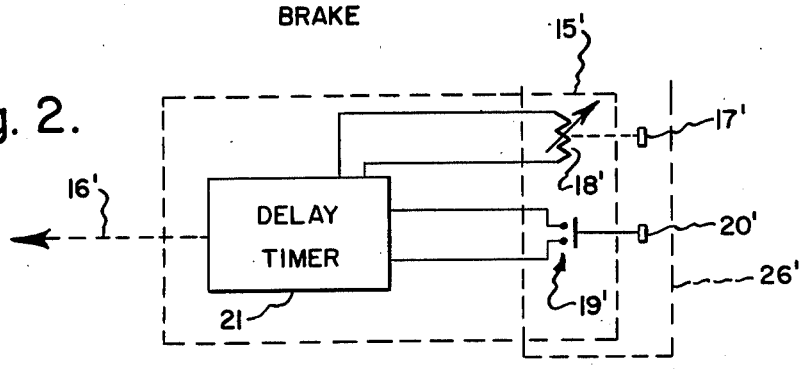
Fig. 3.
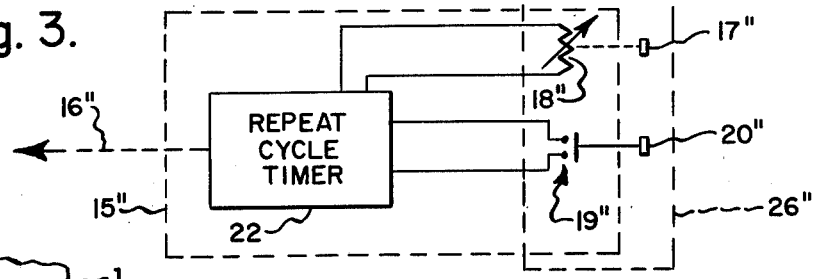
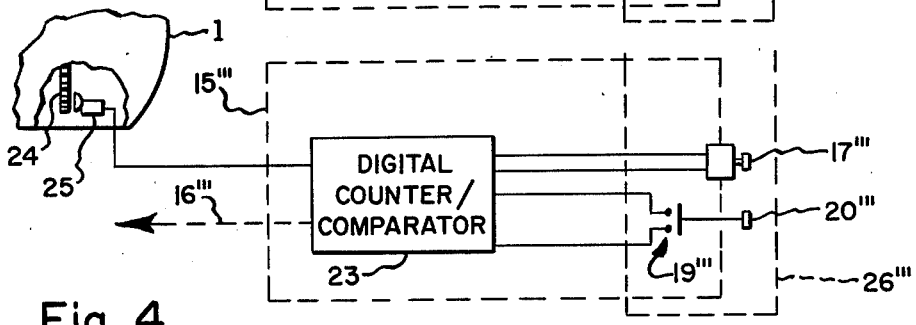
Fig. 4.

PRECISE LOAD POSITIONER

This application is a continuation of Ser. No. 010,070, filed Feb. 7, 1979, now abandoned.

TECHNICAL FIELD OF THE INVENTION

The present invention relates to precise load positioners for hoists. More specifically, the invention relates to a load positioner for an electric or other type of hoist and operates by releasing the hoist brake for short periods of time without hoist motor operation.

BACKGROUND OF THE INVENTION

Operators of industrial hoists designed for lifting heavy loads frequently must move the load to a precise position such as is required when a large workpiece is inserted into a lathe or other metal forming tool. In other circumstances it is desireable to gently lower a heavy load from an elevated, suspended position to a rest position in a manner which avoids marring either the suspended load or the support surface. In many instances these types of maneuvers have proven difficult to accomplish and have required extraordinary measures for their satisfactory completion.

In an attempt to solve this positioning problem, many have purchased expensive two speed hoists which have normal and low speeds: the hope being that the low speed would enable more precise positioning of a load. Such is not the case however. Even the low speed operating mode of a two speed hoist does not permit precise load positioning without up and down jogging which itself is not a completely satisfactory solution since actuation of the hoist cannot be precisely controlled by manual actuation so that final position depends of chance.

Another prior approach to the problem has been to insert a micro-positioning device intermediate the hoist and the load as disclosed in U.S. Pat. No. 3,730,484. Such a device, however, reduces the vertical distance that a given hoist can lift a load by an amount equal to the vertical dimension of the device, or requires the hoist to be raised to a higher position to compensate for the vertical distance occupied by insertion of the device intermediate the hoist and load. Furthermore, such devices, whether they operate on pneumatic power, hydraulic power or electrical power, permit the uncontrolled drop of the load by the vertical throw of the device upon loss of such power.

Other approaches have been attempted such as those disclosed in U.S. Pat. Nos. 2,752,120 and 2,801,760 with varying degrees of success. These other approaches, however, require major mechanical components such as fluid couplers and vertically adjustable pulleys and are not easily retrofit to an existing hoist if such retrofit is possible at all. Thus, in most instances, hoist operators have had to cope with a hoist without the assistance of these above mentioned load positioning devices. Experienced hoist operators using a conventional hoist attempt to obtain a precise position by first moving the load to the approximate desired height and then "jogging" the hoist up and down until the load chances to be positioned at the desired height. This "jogging" technique obviously is hard on hoist components, especially the motor relays and contactors and the brake and is entirely unsuitable where the load must be delicately lowered to a fixed rest surface. Inexperienced hoist operators on the other hand are apt to hold the hoist "down" control for too long a period so that the load tends to over run the point of load location thus damaging the part or the machine.

THE INVENTION

The present invention solves these and other problems in a simple, inexpensive, and elegant manner and lends itself to retrofitting single speed or dual speed hoists. Accordingly, a device is provided for modifying a standard hoist in order to enable that hoist to precisely position a suspended load. The device of the invention operates by temporarily causing the hoist brake to be released for a predetermined limited time period without actuating the hoist motor so that the load is lowered through a small incremental distance under the influence of its own weight.

In order to satisfy these objects, the present invention proposes a hoist control system which, when triggered by the hoist operator, generates a brake release control signal for a precisely determined period of time which is not subject to operator induced uncertainties. The control system is adjustable so as to permit increase or decrease of the duration of the control signal. When the hoist operator triggers the control system, the control signal is delivered to a two state control device which controls the brake such as a switch in the case of an electrically operated brake or an off-on valve in the case of a pneumatically or hydraulically operated brake. The control signal thus controls the operative state of the control device in a manner which is predictable and repeatable and not subject to the uncertainties inherent in manual control. In this manner, the hoist brake mechanism may be released for a very short and precise period to bring about a very small, carefully controlled vertically downward movement of the load.

The signal generating means of the control system may consist of a delay timer having means for adjustably determining the duration of the generated signal, a repeat cycle timer having means for adjustably determining the duration of the generated and repeated signals as well as for adjustably determining the hiatus separating the repeated signals, or a digital clock and counter which generates a sequence of digital pulses at predetermined time intervals. An alternate form of the present invention includes means for detecting the actual movement of the hoist so that the brake may be reapplied after the load has been downwardly shifted through a precise predetermined distance.

The present invention further contemplates physically positioning the trigger control button and the pulse duration control dial on the pendant hoist control station so that the precise load positioner may be conveniently and easily operated by the hoist operator.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 1 is a circuit diagram which schematically represents an electric hoist as modified by the precise load positioner of the present invention; and FIGS. 2, 3 and 4 are symbolic schematic representations of different embodiments of the precise load positioner control of the present invention.

DESCRIPTION OF THE BEST MODE OF THE INVENTION

While the present invention is susceptible of various modifications and alternative constructions, there is shown in the drawings and there will hereinafter be described, in detail, a description of the presently preferred embodiment of the invention. It is to be understood however, that the specific description and drawings are not intended to limit the invention to the specific form disclosed. On the contrary, it is intended that the scope of this patent include all modifications and alternative constructions thereof falling within the spirit and scope of the invention as expressed in the appended claims to the full range of their equivalents.

Referring now to FIG. 1, a simplified representation of a typical single speed hoist is illustrated as including an electric motor 1, a hoist lift wheel 3 connected to the electric motor by a drive shaft 2, and an electric brake 4 operatively connected to both the electric motor and the hoist lift wheel also by drive shaft 2. The brake is shown in a simplified manner to include friction plate 5 and brake plate 6 which are normally urged together in load supporting mutual engagement by springs 8. While an electric hoist has been illustrated as an example for purposes of convenience, it should be recognized that the principals of the invention are equally applicable to a pneumatically powered hoist or even a hydraulically powered hoist. With this caveat understood, the exemplary electric hoist depicted is powered by a power supply 9 and operates when switch or relay 10 is closed through the influence of the operation of the hoist control 12, the functional relationship between the hoist control 12 and the status of switch 10 being illustrated by dotted line 13. Switch or relay 10 is normally a reversing switch to provide both "up" and "down" hoist operating modes but has been simplified to appear as a single direction switch for purposes of clarity in this description. As can be seen, operation of the hoist control 12 also influences the closed/open status of relay or switch 11 which connects power supply 9 to electromagnet 7. When closed, electromagnet 7 is energized and pulls brake plate 6 from friction plate 5 against the bias of springs 8, thereby releasing the brake 4. Motor 1 is operated and brake 4 is released at about the same time during normal hoist operation.

In accordance with the concept of the present invention, an additional portion of the hoist control system is illustrated in FIG. 1 as including switch or relay 14 responsive to the control signal delivered via dotted line 16 from the precise load positioner control system 15. As can be seen, switch 14 is arranged in parallel with switch 11 so that its actuation is also capable of energizing electromagnet 7 and releasing brake 4. Switches 11 and 14 have been functionally illustrated as being separate for the purposes of pointing out that the system illustrated is effective to release brake 4 without concurrent actuation of the hoist motor 1. In actual practice however, the preferred physical arrangement might be the unification of switches 11 and 14 with the precise load positioner control signal being effective to operate switch 14 without concurrent operation of switch 10.

At this point is should be noted that broken line 26 is shown as encompassing the up and down push button controls of the hoist control 12 as well as a trigger push button 20 and potentiometer dial control 17 which are the manually actuated controls of the precise load positioning system 15. Broken line 26 therefore delineates that portion of each of these systems 12 and 15 which are physically separated from the hoist itself and remotely positioned in a pendant hoist control station readily accessible to an operator at ground level. It should also be noted that the down button of the hoist control 12 might be constructed as a two stage button with the precise load positioning control coming into operation at a first degree of depression while the normal down control is triggered by depression of the down button to a second degree of depression.

Turning now to an examination of FIGS. 2, 3 and 4, the functional operation of the precise load positioner control 15 will become apparent. In the first embodiment shown in FIG. 2, the precise load positioner control numbered 15' includes a delay timer 21 which generates a control signal to operate switch 14 via line 16'. The control signal generated by delay timer 21 has a duration which may be manually determined by the variable resistor or potentiometer 18' as set by manipulation of control dial 17'. Delay timer 21 is triggered by the closure of switch 19' through depression of trigger button 20'. Accordingly, in the embodiment shown in FIG. 2, the precise load positioning lowering function consists of a one shot signal for each depression of button 20' and which releases the electric brake for a predetermined limited time period. Delay timer 21 however can be reset and retriggered by subsequent release and reactuation of trigger control button 20'.

In FIG. 3, the preferred embodiment is shown as including a repeat cycle timer 22 which generates a plurality of signal pulses so that continued application of pressure on button 20'' and closure of relays 19'' causes the generation of a sequence of control signal pulses which are delivered to operate the switch 14 via line 16''. Accordingly, the precise load positioner control 15'' intermittently releases and reapplies brake 4 so that the load may be lowered under its own weight in a controlled step by step manner. The duration of each pulse in the sequence of pulses generated by repeat cycle timer 22 can be adjustably determined by variaton of potentiometer of variable resistor 18'' through the manipulation of dial 17''. This feature is desireable to adjust the precise load positioner in response to the load lifted. Since in the operation of the invention, the load is permitted to move down under its own weight, shorter control signal pulses are required for heavy loads than for lighter loads. Additionally, it might also be desireable to provide a repeat cycle timer 22 which can vary the length of the hiatus between successive control pulses thereby giving the operator more time to observe the degree of lowering and to release button 20'' thereby terminating load lowering.

Application of digital art techniques to the present invention is also possible. Accordingly, the precise load positioner control 15 may consist of a digital clock and digital pulse generator which generates a digital pulse only at selected intervals. Switch 14 would then be modified to be responsive to the digital pulses delivered thereto via 16 and might operate in the manner of a flip-flop which cycles switch 14 between its closed and its open states upon receipt of each of the digital pulses at the designated time intervals.

Turning now to FIG. 4, an embodiment is illustrated as including a transducer 25 which detects motion of the hoist motor 1 and converts this motion into an analog or digital signal proportional thereto. Control system 15''' and brake release may be responsive directly to a degree of load movement rather than to a preset time period.

For example, one arrangement might be a gear tooth detector 25 which monitors the pinion gear 24 of hoist motor 1 and generates a digital pulse corresponding to the passage of each of the teeth of the gear as its passes the location of the transducer 25. The pulsed signal could then be delivered to a digital counter which has been preset to count the pulses from transducer 25 after contacts 19''' and switch 14 have been closed. When the total number of pulses received from transducer 25 equals the predetermined number selected by the operator and dialed into the digital counter/comparator 23 by dial 17''', the digital counter/comparator 23 terminates the brake release control signal thereby allowing switch 14 to reopen and the brake 4 to reengage so as to halt load descent. In this embodiment and in this manner the incremental distance through which the load is lowered may be precisely determined. As will be recognized, this mode of operation is independent of the time that it takes the load to descend since the control signal from the precise load positioner is dependent upon load movement rather than time.

While a preferred embodiment has been illustrated and described, it is evident that a variety of additional modifications and alternative constructions which fall within the scope of the invention may be desirable in certain circumstances: one such modification which may be found desirable includes an additional enablement control system which permits operation of the precise load positioner within certain load elevations. Accordingly, the enablement control system overrides the precise load positioner control so as to prevent a hoist operator from lowering a load by means of the precise load positioner over relatively large distances. Thus, the precise load positioner control would be enabled only in those regions of hoist operation where precise positioning is usually desirable such as at or near ground level and at or near some other level such as the elevation of a workpiece in a lathe.

While a variety of arrangements might be devised to achieve an enablement control system, the arrangement most easily incorporated in a typical hoist is the addition of microswitches and the appropriate enablement circuitry to the hoist in a manner similar to that already present in hoists in the form of limit control switches.

What is claimed is:

1. A precise positioner control system for targeting the lowering of a load which is suspended at an elevated position by means of a hoist of the type having a motor for driving the load lift wheel of the hoist and a brake co-acting with the lift wheel drive system such that when the hoist motor is actuated the brake is automatically released to permit the motor to drive the hoist and lift the load carried thereby, and when the motor is deactuated the brake is automatically engaged to prevent the load from lowering with respect to the hoist; said precise positioner control system being characterized by having:

manual control means manually operable only when said motor is deenergized for releasing said brake so as to permit the load carried by the hoist to descend in response to gravity forces, and automatic control means adapted to be pre-set so as to be automatically operable to reset said brake following a manually uncontrollable interval of predetermined extent subsequent to manually controlled release of said brake, so as to terminate said brake release function as the load arrives precisely at the operator's preselected lower target elevation, and wherein said automatic control means incorporates power supply switching means arranged so that upon operator-continuance of operation of said manual control means said auotmatic control means functions repetitively so as to permit lowering of said load successively throughout a series of automatically controlled periods of time until operation of said manual control means is discontinued.

2. The load positioner as recited in claim 1 characterized in that said means for releasing said brake may be adjusted to increase or decrease said time periods.

3. The load positioner as recited in claim 1 characterized in that said means for releasing said brake includes a timer which generates a brake release control signal for the duration of said predetermined time periods.

4. The load positioner as recited in claim 1 characterized in that said means for releasing said brake includes a timer which generates a plurality of control signal pulses, each pulse being separated one from another by a hiatus of predetermined duration.

5. The load positioner as recited in claim 4 characterized in that said control signal pulses each have a duration equal to said predetermined time periods.

6. The load positioner as recited in claim 5 wherein said brake is controlled from a remote pendant control station, characterized in that:

said means for releasing said brake includes a control signal duration adjustment control and an actuation control, both of which are located in said pendant control station.

7. The load positioner as recited in claim 1 wherein said brake is controlled from a remote pendant control station, characterized in that:

said means for releasing said brake includes a control signal duration adjustment control and an actuation control, both of which are located in said pendant control station.

8. The load positioner as recited in claim 4 wherein said hiatus of predetermined duration may be adjustably set.

9. A precise positioner control system for targeting the lowering of a load which is suspended at an elevated position by means of a hoist of the type having a motor for driving the load lift wheel of the hoist and a brake co-acting with the lift wheel drive system such that when the hoist motor is actuated the brake is automatically released to permit the motor to drive the hoist and lift the load carried thereby, and when the motor is deactuated the brake is automatically engaged to prevent the load from lowering with respect to the hoist; said precise positioner control system being characterized by having:

manual control means manually operable only when said motor is deenergized for releasing said brake so as to permit the load carried by the hoist to descend in response to gravity forces, and automatic control means adapted to be pre-set so as to be automatically operable to reset said brake following a manually uncontrollable interval of predetermined extent subsequent to manually controlled release of said brake, so as to terminate said brake release function as the load arrives precisely at the operator's preselected lower target elevation, and wherein said automatic control means incorporates power supply switching means arranged so that upon operator-continuance of operation of said manual control means said automatic control means functions repetitively so as to permit lowering of said load throughout a series of successively automatically controlled minute distances of load travel until operation of said manual control means is discontinued.

10. The load positioner as recited in claim 9 characterized in that said means for releasing the brake includes signal generating means for detecting load movement and for generating a signal proportional thereto; and means responsive to said signal generating means for reapplying said brake after the completion of a predetermined load movement.

11. The load positioner as recited in claim 10 characterized in that said signal generating means includes a sensing means responsive to a hoist gear for detecting gear rotation.

* * * * *